US006227011B1

(12) United States Patent
Cortinovis

(10) Patent No.: US 6,227,011 B1
(45) Date of Patent: May 8, 2001

(54) TUBULAR KNIT AND SHAPED EAR-COVERING BAND AND METHOD FOR ITS MANUFACTURE

(75) Inventor: Giulio Cortinovis, Collebeato (IT)

(73) Assignee: Sockwise, Inc., Tucson, AZ (US)

( * ) Notice: Subject to any disclaimer, the term of this patent is extended or adjusted under 35 U.S.C. 154(b) by 0 days.

(21) Appl. No.: 09/515,159

(22) Filed: Feb. 29, 2000

(51) Int. Cl.[7] ..... A41D 20/00

(52) U.S. Cl. ..... 66/171; 66/8; 2/DIG. 11; 2/171

(58) Field of Search ..... 66/169 R, 170, 66/171, 173, 180, 8, 17; 2/120, 171, DIG. 11

(56) References Cited

U.S. PATENT DOCUMENTS 1,597,410 * 8/1926 Hinchliff ..... 66/171
3,184,758 * 5/1965 Hirsch ..... 66/171
4,047,400 * 9/1977 Thorneburg ..... 66/171
4,499,741 * 2/1985 Harris ..... 66/171
4,517,685 * 5/1985 Lesley ..... 359/518
5,305,470 * 4/1994 McKay ..... 2/7
5,823,012 * 10/1998 Hacskaylo ..... 66/171

* cited by examiner

*Primary Examiner*—Danny Worrell
(74) *Attorney, Agent, or Firm*—McGlew and Tuttle, P.C.

(57) ABSTRACT

An ear-covering band is provided which is formed by a straight, tubular knit manufactured article having at least one shaped intermediate part, and in which the edges of the ends of the said tubular knit element are brought together and joined by means of sewing in order to form an annular knit article. A method is provided for manufacturing the ear-covering band on a circular stocking knitting machine.

2 Claims, 1 Drawing Sheet

TUBULAR KNIT AND SHAPED EAR-COVERING BAND AND METHOD FOR ITS MANUFACTURE

FIELD OF THE INVENTION

The present invention pertains to a knit ear-covering band and a method for its manufacture on circular tubular knitting machines, such as circular machines for manufacturing men's socks.

BACKGROUND OF THE INVENTION

Knit ear-covering bands, which are made by cutting out and appropriately sewing a starting knit piece, are known and available at this time.

SUMMARY AND OBJECTS OF THE INVENTION

One object of the present invention is to propose an ear-covering band which can be directly manufactured on the circular stocking knitting machines and with a simple final closing operation.

Another object of the present invention is to propose an annular ear-covering band, which is formed by a tubular knit manufactured article with varied elasticity or intensity in some of its parts in order to prove to be more wearable and more comfortable in use.

Still another object of the present invention is to provide an annular ear-covering band that is shaped on at least one segment of its extension which is intended to cover the forehead.

Another object of the present invention is to propose a method of knitting for manufacturing a tubular knit and shaped ear-covering band directly on circular stocking knitting machines without remnants.

Said objects are accomplished with an ear-covering band formed by a manufactured article having a straight tubular knit and with at least one shaped intermediate part and in which the edges of the opposite ends of said element are brought together and joined by means of sewing in order to form an annular knit article.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
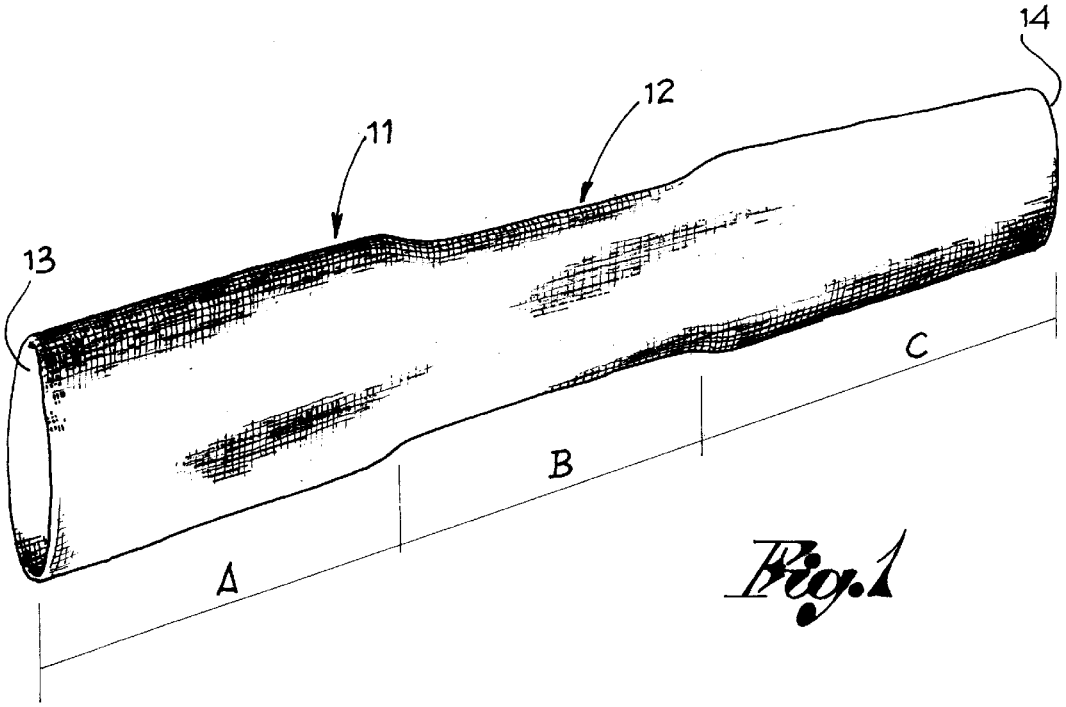
FIG. 1 is a perspective view of the starting tubular knit manufactured article for the manufacture of the final band.

Referring to the drawings in particular, initially, a straight tubular knit article 11, which has a shaped intermediate part 12 or varying elasticity or density of the knit, is manufactured.

The article 11 is manufactured on a circular stocking knitting machine that is known per se, beginning from one end 13 and ending at the other end 14 of the manufactured article. The circular stocking knitting machine may have one or more feeding and knitting stations. The present method, for greater simplicity, is described as carried out on a circular machine with a single knitting station, with it being, however, understood that the same procedure is repeated in each knitting station in the machines with multiple stations.

The knit of the tubular element 11 is made with the use of a first basic yarn which may be an elastomer, usually consisting of at least one elastic yarn and of a nylon yarn which are combined, a second basic yarn, or woof yarn, which may be of natural or synthetic fibers, and a third, additional yarn, which may be of any type.

The manufactured article 11 is started, as in the manufacture of a stocking (if necessary even without a usual hooking), by loading at least the first and the second yarns on a yes needle (an odd-numbered needle) and a no needle (even-numbered needle) of the needles available on the rotating cylinder of the circular machine. After one or more series or rows of stitches, the knitting is started with all the needles of the machine and with all the first, second and third yarns. However, the needles are made to knit with an alternate 1:1 selection, meaning with this that, during a rotation of the cylinder with needles, e.g., only the odd-numbered needles are selected for knitting and only the even-numbered needles during the next rotation.

For an entire first segment A of the length of the manufactured article, all the odd- and even-numbered needles are fed with, and knit, either the first or the second basic yarn and alternately pick up the third, additional yarn. In other words, the odd-numbered needles pick up the additional yarn during a rotation of the cylinder and the even-numbered needles during the next rotation. The additional yarn is not knit, forming stitches, but is only "additional," and is interfaced with the first and second basic yarns. To do this, the additional yarn is fed into a special feed station that is arranged downstream (following the direction of rotation of the cylinder) of the main station for feeding the basic yarns. The supply of the additional yarn is used to voluminize the knit in that part A of the manufactured article.

At the end of the said first part A of the manufactured article, the feeding of the third, additional yarn stops and the manufacturing of a second part B of the manufactured article starts with the supply of only the first and second basic yarns. In this second segment, the needles may again be selected with an alternate 1:1 selection as above, or, as an alternative, may all work at the same time or according to another, different selection, if desired. Therefore, the second segment B of the manned article has a knit that is lighter and more elastic than the first segment. Once the second segment of the manufactured article is finished, the knitting of a third segment C of the said manufactured article begins, selecting the needles and feeding all the yarns, second and third, as in the first part A of the manufactured article. The manufactured article is then unloaded from the needles of the machine with which it was manufactured.

The manufactured article is thus going to have a first and a third "volumized" knit segment thanks to the supply of the additional yarn and an intermediate knit segment, diversified because of the absence of the additional yarn, and which contributes to providing a shape and elasticity features that are particular to the manufactured article proper (FIG. 1).

Figure 2:
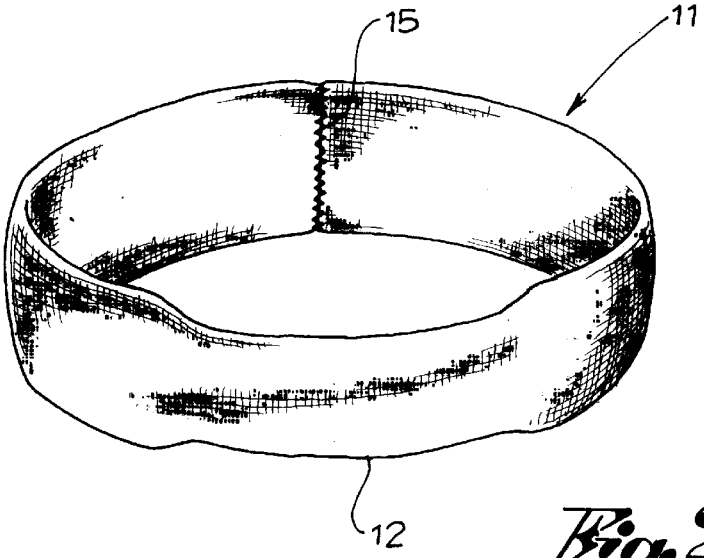
FIG. 2 is a perspective view showing the ear-covering band when finished.

Finally, the manufactured article is picked up again, folded, and closed in an annular shape by bringing together and joining the edges of its opposite ends by means of sewing 15, thus creating an ear-covering band, which is shaped as predicted (FIG. 2).

While a specific embodiment of the invention has been shown and described in detail to illustrate the application of the principles of the invention, it will be understood that the invention may be embodied otherwise without departing from such principles.

What is claimed is:

1. A method for manufacturing a tubular-knit ear-covering band on a circular knitting machine having a plurality of needles mounted on a rotating cylinder, comprising the manufacture steps of:

forming a first tubular knit segment by knitting at least a first basic yarn together with a second basic yarn and with the addition of a third yarn;

forming a second tubular knit segment by knitting the first and second basic yarns together;

forming a third tubular knit segment by knitting said first basic yarn together with said second basic yarn and with the addition of said third yarn as in the first tubular knit segment;

providing one of said basic yarns as an elastomer yarn;

providing said second yarn and said additional yarn as the same or different from one another and made of natural or synthetic fibers;

unloading the tubular knit manufactured article thus obtained by forming with the circular knitting machine;

picking up the tubular manufactured article again and then folding it into an annular shape; and bringing together and joining the edges of its opposite ends by means of sewing, wherein said first and third tubular knit segments are manufactured with an alternate 1:1 selection of the needles of the circular machine for knitting the first and second basic yarns with the addition of the said third yarn with odd-numbered needles during a rotation of the cylinder and with even-numbered needles during a next rotation, said second tubular knit segment being able to be made of a smooth knit or with any selection, knitting only said first and second basic yarns.

2. A tubular-knit ear-covering band manufactured on a circular knitting machine having a plurality of needles mounted on a rotating cylinder, the ear covering band being manufactured by the steps comprising:

forming a first tubular knit segment by knitting at least a first basic yarn together with a second basic yarn and with the addition of a third yarn;

forming a second tubular knit segment by knitting the first and second basic yarns together;

forming a third tubular knit segment by knitting said first basic yarn together with said second basic yarn and with the addition of said third yarn as in the first tubular knit segment;

providing one of said basic yarns as an elastomer yarn;

providing said second yarn and said additional yarn as the same or different from one another and made of natural or synthetic fibers;

unloading the tubular knit manufactured article thus obtained by forming with the circular knitting machine;

picking up the tubular manufactured article again and then folding it into an annular shape; and bringing together and joining the edges of its opposite ends by means of sewing, wherein said first and third tubular knit segments are manufactured with an alternate 1:1 selection of the needles of the circular machine for knitting the first and second basic yarns with the addition of the said third yarn with odd-numbered needles during a rotation of the cylinder and with even-numbered needles during a next rotation, said second tubular knit segment being able to be made of a smooth knit or with any selection, knitting only said first and second basic yarns.

* * * * *